US006764201B2

(12) United States Patent
Chi-Cheng

(10) Patent No.: US 6,764,201 B2
(45) Date of Patent: Jul. 20, 2004

(54) INFLATABLE FIGURE ASSEMBLY

(75) Inventor: Tsai Chi-Cheng, Pingtung (TW)

(73) Assignee: Gemmy Industries Corporation, Irving, TX (US)

( * ) Notice: Subject to any disclaimer, the term of this patent is extended or adjusted under 35 U.S.C. 154(b) by 0 days.

(21) Appl. No.: 10/378,186

(22) Filed: Mar. 3, 2003

(65) Prior Publication Data

US 2004/0047144 A1 Mar. 11, 2004

Related U.S. Application Data

(63) Continuation-in-part of application No. 10/042,622, filed on Jan. 9, 2002, now Pat. No. 6,644,843.

(51) Int. Cl.[7] ..... F21V 11/00

(52) U.S. Cl. ..... 362/352; 362/96; 362/808; 446/221; 446/226; 40/412

(58) Field of Search ..... 362/352, 96, 249, 362/806, 808, 186; 446/221, 226; 40/410, 412

(56) References Cited

U.S. PATENT DOCUMENTS

| | | | | |
|---|---|---|---|---|
| 2,383,390 A | | 8/1945 | Jacobs | |
| 2,593,188 A | | 4/1952 | Rikelman | |
| 3,250,024 A | | 5/1966 | Douthitt et al. | |
| 3,363,350 A | | 1/1968 | Moran | |
| 3,672,083 A | | 6/1972 | Moran | |
| 3,745,677 A | | 7/1973 | Moran | |
| 3,835,308 A | | 9/1974 | Reese | |
| 4,837,958 A | | 6/1989 | Radovich | |
| 4,932,169 A | | 6/1990 | Charbonneau | |
| 4,991,363 A | | 2/1991 | Randmae | |
| 5,467,543 A | | 11/1995 | Fink et al. | |
| 5,471,797 A | | 12/1995 | Murphy | |
| 6,238,067 B1 | * | 5/2001 | Hirsch | 362/352 |
| 6,305,827 B1 | * | 10/2001 | Nolle | 362/352 |

FOREIGN PATENT DOCUMENTS

| | | |
|---|---|---|
| CN | ZL01271174.8 | 10/2002 |
| CN | ZL01271175.6 | 10/2002 |

* cited by examiner

*Primary Examiner*—Alan Cariaso
*Assistant Examiner*—Ali Alavi
(74) *Attorney, Agent, or Firm*—Monty L. Ross; Locke Liddell & Sapp LLP

(57) ABSTRACT

An inflatable figure assembly is disclosed that has an inflatable, semi-permeable body and a base unit with a continuously operating fan. The body is releasably secured to the base unit with a zipper that facilitates manufacture and interchangeability of a plurality of different bodies with the base unit. Internal lighting is optionally provided.

8 Claims, 4 Drawing Sheets

INFLATABLE FIGURE ASSEMBLY

CROSS-REFERENCE TO RELATED APPLICATION

This application is a continuation-in-part of application Ser. No. 10/042,622, filed Jan. 9, 2002 now U.S. Pat. No. 6,644,843, and claims the priority date of that application for all common subject matter disclosed herein.

BACKGROUND OF THE INVENTION

1. Field of the Invention

This invention relates to inflatable figures useful for consumer or commercial applications. More particularly, the invention relates to inflatable figures attached to a fan mechanism that supplies pressurized air to the interior cavities of such figures continuously during use. These inflatable figures can be displayed in yards, homes or businesses for seasonal decorating or other personal or business purposes.

2. Description of Related Art

Inflatable figures have previously been disclosed, for example, in U.S. Pat. Nos. 6,431,729; 6,322,230; 6,186,857; 5,710,543; and 4,179,832. Such figures are often made from plastic, nylon or other similar materials or fabrics that are inflatable for display purposes but can be folded and stored in a reduced volume when deflated. Inflatable figures are often made to simulate people, fictional characters, animals, or inanimate objects. Some inflatable figures have interiors devoid of any apparatus and others are provided with interior baffles, lighting or other components or structures. Inflatable figures often comprise rings, loops or other similarly effective devices for attaching tethers, guys or tie-downs to stakes or anchors, depending upon the size, configuration, intended display site and possible exposure to wind.

Some inflatable figures are made of materials that are substantially impermeable to air and can be inflated, then sealed to prevent air loss during use. Vinyl plastic is often used in making such figures, but vinyl is relatively heavy and is susceptible to punctures and melting upon contact with heat sources such as internal lighting.

Other inflatable figures are attached to inflation fans that run continuously during use. This latter type of inflatable figures are typically made using lighter weight, semipermeable fabrics such as nylon. The figures can have an interior cavity that is substantially continuous except for the air inlet port; or can contain one or more access ports that can be selectively opened and closed; or can contain one or more vent ports that are open continuously but have a total cross-sectional area sufficiently restricted to permit the figure to inflate and remain in some state of inflation during use. Examples of vented figures are the so-called "undulating figures" having vented extremities that alternately fill and collapse to simulate motion.

In the past, inflatable figures having attached base units comprising fans that operate continuously during use have typically been made by permanently or semi-permanently attaching the lower portion of the fabric body of the figure to the underlying base. Such construction is shown, for example, in the copending application referenced above. The manufacture of inflatable figures in this way has been found to be inefficient and costly. First, the entire fabric body must be handled and manipulated during the attachment process. Second, once a particular figure is attached, the base unit is effectively dedicated to that particular figure or character configuration. This prevents a single base unit from being selectively used with one or more different figures.

Although freestanding fans have been provided in the past that are connected to large inflatable figures using flexible hoses, this technique is not satisfactory for use with self-contained inflatable figures having a fan-containing base unit to which the body of the figure itself is attached.

The disadvantages of the prior art inflatable figures are avoided through use of the invention disclosed herein.

SUMMARY OF THE INVENTION

An inflatable figure assembly is disclosed herein that preferably comprises a base unit and a figure body that are selectively attachable by means of first and second cooperating zipper portions. A first zipper portion is desirably affixed to an outwardly extending, preferably circular, edge of a fabric collar that is permanently or semi-permanently attached to a base unit comprising a fan. A second zipper portion is desirably affixed to a cooperatively extending and aligned, preferably circular, lower edge of the figure body. The first and second zipper portions are preferably attachable to zip the figure body onto the base unit whenever and wherever desired.

When constructed in this manner, the base unit and figure body can be conveniently made at different locations and packaged independently. If desired, a single base unit can be packaged and sold with two or more different figures that can be selectively attached by the user as needed. If desired, a manufacturer can inventory a supply of base units to which any of several differently figures can be selectively attached upon receipt of orders for a particular figure. Because the collapsed figure bodies typically pack into a smaller volume than the base units, the total warehouse space required to maintain stock sufficient to fill orders can be significantly reduced as compared to stocking the same number of figure bodies, each having a permanently or semi-permanently attached base unit. Additionally, it may not be necessary to stock base units sufficient to "make-up" all the inventoried figure bodies in the manner that would otherwise be required.

As used herein, the term "permanently or semi-permanently attached" means that a lower portion of the fabric or material of a figure body is secured to a housing portion of a fan-containing base unit using such devices or in such manner that either removal is not possible without destroying a portion of the article or removal requires the use of tools. Thus, for example, permanent attachment can include using the clamping frame to secure fabric to a base unit, and attaching the clamping frame to the base unit with rivets or with biased snap fasteners that are not reversibly disengageable. Semi-permanent attachment can include a similar configuration where the clamping frame is attached to the base unit with screws that can be removed using a screwdriver.

BRIEF DESCRIPTION OF THE DRAWINGS

The apparatus of the invention is further described and explained in relation to the following figures of the drawings wherein.

Like reference numerals are used to describe like parts in all figures of the drawings.

DESCRIPTION OF THE PREFERRED EMBODIMENTS

Figure 1:
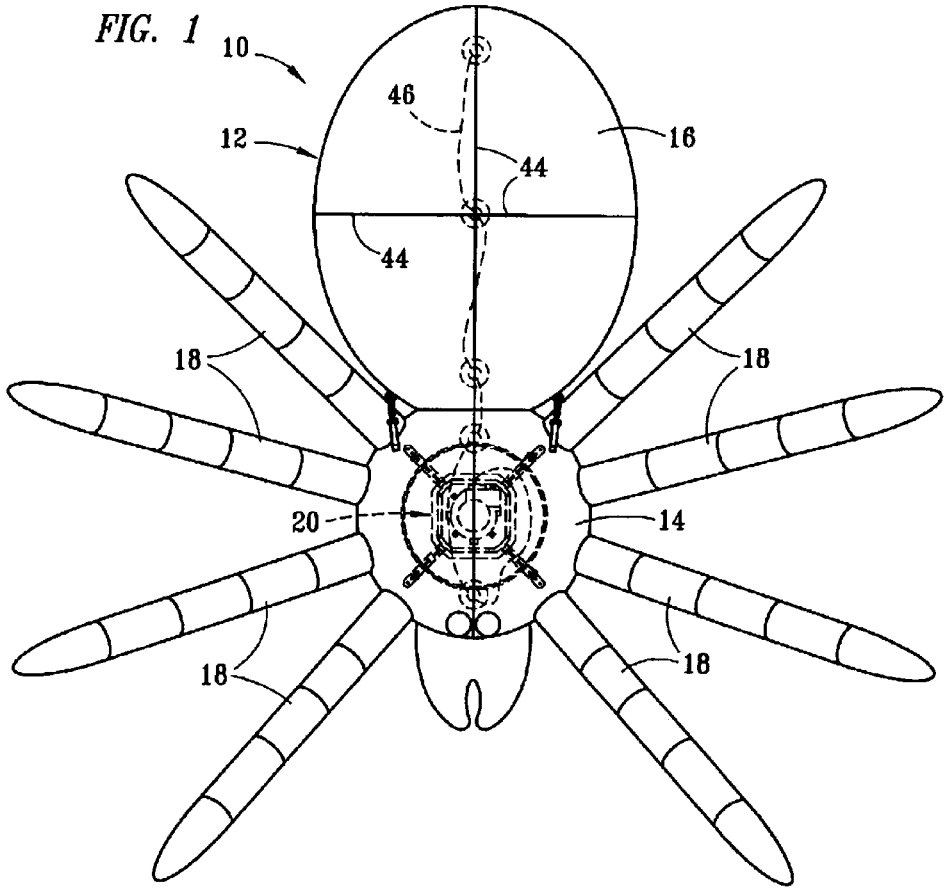
FIG. 1 is a top plan view of an inflatable figure of the invention made in the configuration of a spider.

Referring to FIGS. 1–4, inflatable figure assembly 10 preferably comprises body 12 and base unit 20. Body 12 is depicted in the drawings in the shape of a spider, although it will be appreciated that this is merely illustrative of an infinite number of different figures that can be fabricated to form inflatable FIGS. 10 of the invention. Spider body 12 as shown further comprises head section 14, tail section 16 and a plurality of legs 18. Spider body 12 is preferably made of a semi-permeable fabric, such as nylon or another similarly effective materials, that is relatively lightweight but allows less air to diffuse from body 12 than is introduced into it by a fan in the base unit, as discussed below. Because the fan operates continuously during use, the amount of air discharged by the fan into spider body 12 is desirably sufficient to inflate all sections of body 12 to a fully expanded configuration and thereafter maintain the shape of body 12 notwithstanding some loss of air through the body walls. The interior portions of each section of spider body 12 are in fluid communication and combine to form interior cavity 50.

Figure 2:
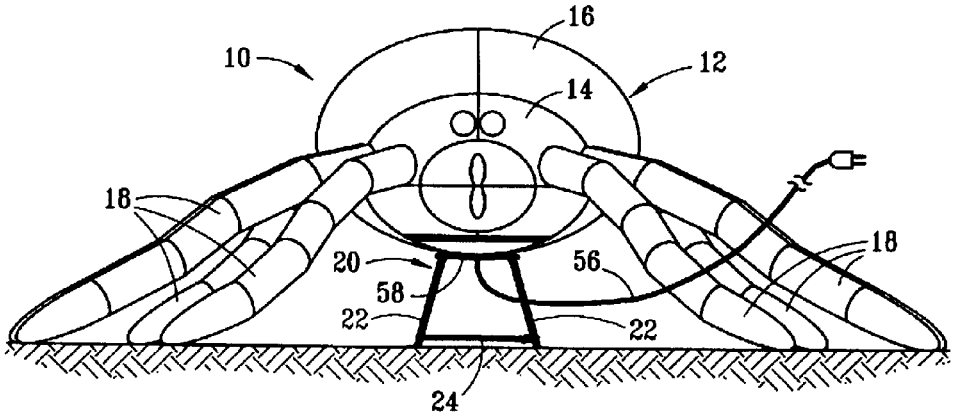
FIG. 2 is a front elevation view of the inflatable figure of FIG. 1 and additionally showing an electrical power cord.
Figure 3:
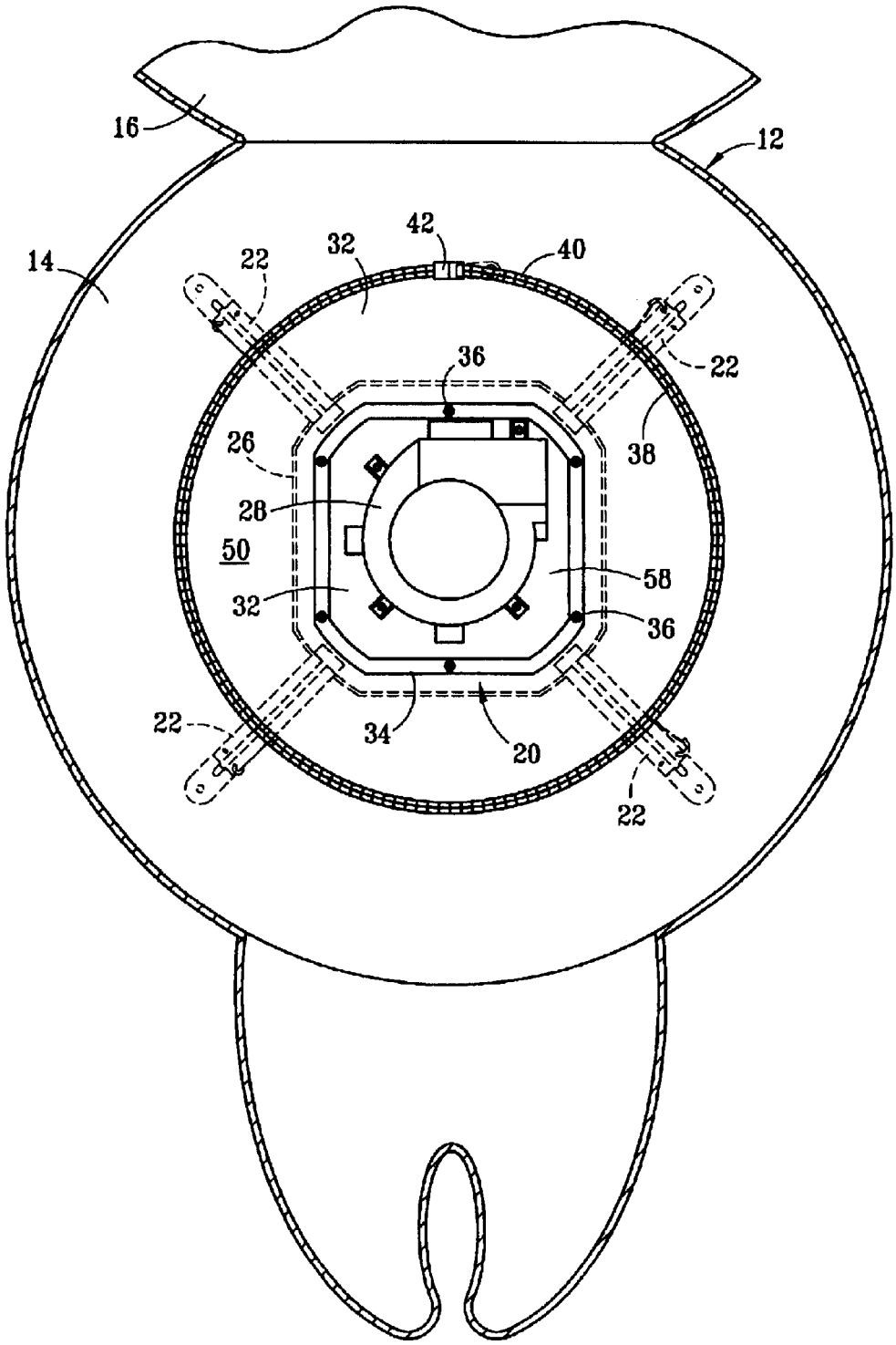
FIG. 3 is an enlarged cross-sectional view looking downwardly on top of the base unit from inside the spider head.
Figure 4:
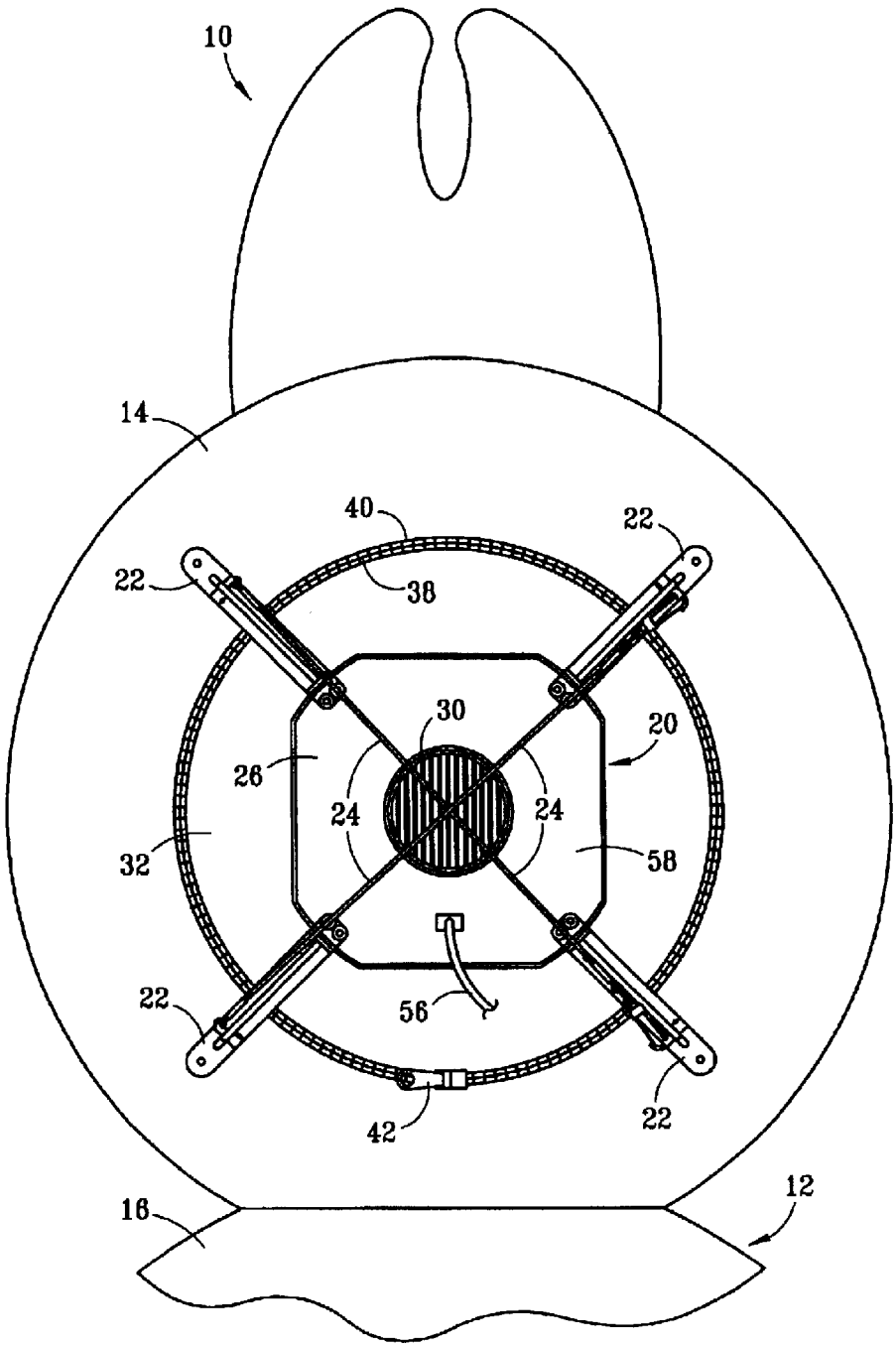
FIG. 4 is an enlarged bottom view of the base unit as installed in the head of the inflatable figure.

A significant feature of the present invention is depicted and discussed in relation to FIGS. 3 and 4 of the preferred embodiment depicted therein. A downwardly extending skirt portion of head section 14 of spider body 12 is preferably provided with a downwardly facing, generally circular opening that terminates in a first zipper section 40 sewn onto the skirt. First zipper section 40 desirably extends completely around the opening and is provided to facilitate attachment to base unit 20. It will be appreciated that attachment loops, D-rings or the like can also be provided on the outside of inflatable FIG. 10 to aid in securing the figure to an underlying support surface 58 as seen in FIG. 2, or to another support structure.

Referring to FIGS. 2, 3 and 4, base unit 20 preferably comprises a plurality of hinged legs 22 that collapse around the hinges for shipment and rotate to a fully extended position for use; cross-braces 24 that maintain legs 22 in their fully extended position; and fan support member 26 attached to legs 22 and elevated above support surface 58 (FIG. 2). Fan 28 is connected to fan support member 26 and oriented so as to receive inlet air through air inlet 30 in the bottom of fan support member 26 and discharge pressurized air into cavity 50 above fan support member 26. Electrical power cord 56 (visible in FIG. 2) is provided for connection to an external source of electrical current. Legs 22, or another similarly effective support structure, are desirably adapted to elevate air inlet 30 at least 14 inches above underlying support surface 58 to comply with requirements of Underwriters' Laboratory.

Base unit 20 preferably further comprises fabric ring 32, clamp member 34, fasteners 36, and second zipper portion 38 for use in connecting base unit 20 to first zipper portion 40 of head section 14. Fabric ring 32 is preferably made of the same or a stronger material as that used for spider body 12 and has a central aperture capable of fitting over and around fan 28. During manufacture of base unit 20, fabric ring 32 is desirably positioned around fan 28 and against the upwardly facing surface of fan support member 26. Clamping member 34 is then applied over the top of fabric ring 32 and is secured to fan support member 26 so as to firmly hold fabric ring 32 in contact therewith. Clamping member 34 is depicted in FIG. 3 as a unitary structure that surrounds fan 28 but can alternatively comprise a plurality of individual sections, each of which is preferably attached to fan support member 26 using fasteners 36 such as screws, rivets or snap-in protrusions that are not easily disengaged during normal use.

Fabric ring 32 further comprises an outside peripheral edge to which a second zipper portion 38 is secured, preferably by sewing. The size and shape of first zipper portion 40 of head section 14 and second zipper portion 38 of fabric ring 32 are preferably such that they are alignable and releasably attachable using a conventional zipper fastening device 42. Through use of a zipper connection as disclosed herein to attach spider body 12 to base unit 20 of inflatable FIG. 10, it is now possible to make and store the figure bodies apart from the base units for subsequent attachment when and where desired.

Figure 5:
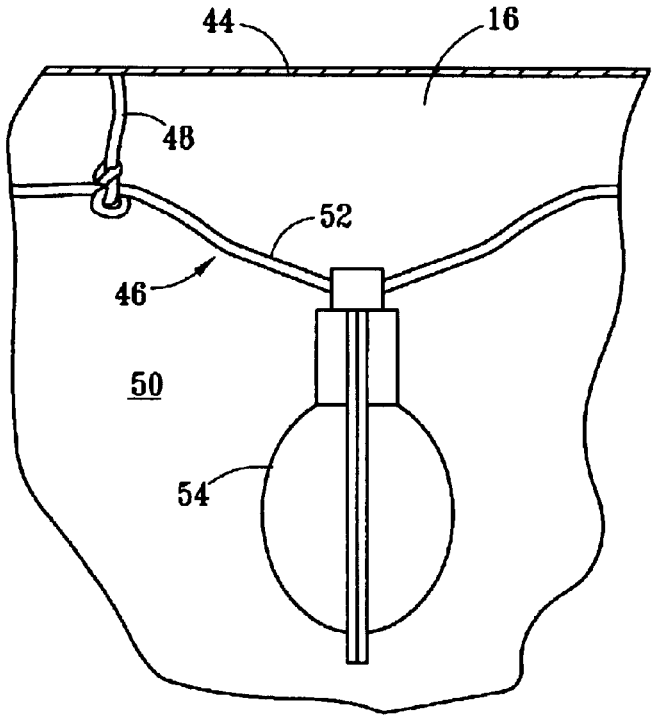
FIG. 5 is an enlarged detail view showing a decorative light string as installed inside the tail section of the spider.

Referring to FIG. 5, an enlarged, broken-away interior portion of tail section 16 is depicted for the purpose of illustrating how decorative light string 46 as shown in FIG. 1 can be attached to spider body 12 inside cavity 50. As shown in FIG. 5, electrical conductor 52 of decorative light string 46 is supported inside cavity 50 by a light string attachment device such as tie 48, which is depicted as being suspended from seam 44 in tail section 16. Bulb unit 54 is merely an example of transparent or translucent protective covers that can be used to prevent direct contact between an incandescent bulb and the material of which spider body 12 is constructed.

Other alterations and modifications of the subject invention will likewise become apparent to those of ordinary skill in the art upon reading this disclosure and the inventor intends that the invention be limited only by the maximum enforceable scope of the appended claims to which he is legally entitled.

What is claimed is:

1. An inflatable figure assembly comprising a body and a base unit, the body further comprising a foldable material that is semi-permeable to the passage of air, the body having an internal cavity and a downwardly facing skirt opening terminating in a first zipper portion;

the base unit further comprising a fan support member, a plurality of legs supporting the fan support member above an underlying support surface, a fan positioned to discharge air into the body, an electrical power source, and a fabric ring secured to the fan support member, the fabric ring having a second zipper portion that is cooperatively sized and shaped so as to be alignable with and attachable to the first zipper portion of the body.

2. The inflatable figure assembly of claim 1 wherein the legs of the base unit are hinged.

3. The inflatable figure assembly of claim 1 wherein the base unit further comprises cross-braces interconnecting the legs.

4. The inflatable figure assembly of claim 1 wherein the foldable material is nylon.

5. The inflatable figure assembly of claim 1 wherein the body is internally lighted.

6. The inflatable figure assembly of claim 5 wherein the body further comprises light string attachment devices.

7. The inflatable figure assembly of claim 6 wherein the body further comprises a plurality of seams and the light attachment devices are ties suspended from the seams.

8. The inflatable figure assembly of claim 1 wherein the fabric ring is secured to the fan support member by at least one clamping member.

* * * * *